United States Patent [19]

Landis et al.

[11] Patent Number: 4,915,613

[45] Date of Patent: Apr. 10, 1990

[54] METHOD AND APPARATUS FOR MONITORING PRESSURE SENSORS

[75] Inventors: William R. Landis, Bloomington, Minn.; Paul A. Schimbke, Shorewood; Michael J. Seidel, Wauwatosa, both of Wis.

[73] Assignee: Honeywell Inc., Minneapolis, Minn.

[21] Appl. No.: 301,498

[22] Filed: Jan. 25, 1989

[51] Int. Cl.[4] ..... F23N 5/24

[52] U.S. Cl. ..... 431/6; 137/458; 431/16

[58] Field of Search ..... 137/458; 236/92 R, 92 A; 431/16, 38, 6; 340/588; 62/158

[56] References Cited

U.S. PATENT DOCUMENTS

| | | | |
|---|---|---|---|
| 3,217,782 | 11/1965 | Vosper | 137/458 X |
| 4,184,340 | 1/1980 | Laughlin et al. | 62/158 X |
| 4,285,207 | 8/1981 | Sugiura et al. | 62/158 X |
| 4,407,139 | 10/1983 | Ide et al. | 62/158 X |
| 4,412,328 | 10/1983 | Homa | 371/25 |
| 4,455,656 | 6/1984 | Tanaka et al. | 371/57 |
| 4,502,625 | 3/1985 | Mueller | 236/11 |
| 4,518,345 | 5/1985 | Mueller et al. | 431/24 |
| 4,563,878 | 1/1986 | Baglione | 62/158 X |
| 4,645,450 | 2/1987 | West | 431/12 |

*Primary Examiner*—William E. Wayner
*Attorney, Agent, or Firm*—Kinney & Lange

[57] ABSTRACT

A method and apparatus monitor fuel pressure in a heating system where a controller controls actuation of fuel valves. A fuel pressure limit signal is provided to the controller for determining if the fuel pressure crosses predetermined thresholds. In order to avoid nuisance shut-downs, the fuel pressure limit signal is ignored by the controller for a predetermined time interval after the controller has actuated a fuel valve.

6 Claims, 3 Drawing Sheets

METHOD AND APPARATUS FOR MONITORING PRESSURE SENSORS

BACKGROUND OF THE INVENTION

1. Field of the Invention

This invention relates to monitoring fuel pressure in a heating system. More particularly, this invention relates to monitoring fuel pressure sensors in a heating system.

2. Description of the Prior Art

Industrial heating systems such as ovens, furnaces, and boilers generally have a combustion chamber which is provided with fuel by a fuel main. However, before the fuel reaches the combustion chamber, it typically enters a system of valves, sensors and regulators which is known as a valve train.

In order to achieve proper combustion in the combustion chamber, the fuel pressure at the point where the fuel enters the combustion chamber must be regulated. If, for example, the fuel is gas, and the gas fuel pressure is too high, it is entering the combustion chamber at a very high rate. Therefore, there is less oxygen in the combustion chamber and a fuel-rich environment is created in the combustion chamber. At some point, the gas-to-oxygen ratio will reach a level where there is not enough oxygen present to cause combustion in the combustion chamber. In that case, uncombusted fuel will be pouring into the combustion chamber. This can create a hazardous and explosive condition.

If the gas pressure is too low at the point where it is entering the combustion chamber, the gas-to-oxygen ratio will fall below desired levels. Since there is plenty of oxygen in the combustion chamber, an air-rich environment is created which is nonexplosive. However, the environment in the combustion chamber can become so air-rich that the firing rate (i.e., the rate at which an air-fuel mixture is supplied to the combustion chamber) is not economical for the particular application of the heating system. Also, the environment in the combustion chamber can become so air-rich that there is not even enough fuel for combustion to occur. In either of these cases, it is desirable to be aware of the low fuel pressure and to remedy it.

Until now, it has been customary to use electromechanical pressure switches as limit switches for gas and oil pressures which directly de-energize fuel valves upon detecting a pressure out of limits. However, these create certain problems. Since fuel of any type has mass, and since there is pipe friction to overcome when the fuel flows through a pipe (e.g. gas main), transient pressure changes in the gas main can result from abrupt fuel flow velocity changes which occur, for example, when fuel valves are rapidly opened or closed. Pressure regulators currently used in valve trains have delayed response to flow velocity changes. Therefore, the electromechanical pressure switches often create nuisance shut-downs as a result of responding to the transient pressure changes that occur when fuel valves are opened and closed.

One way which has been used to avoid these nuisance shut-downs is to set pressure limits in the electromechanical pressure limit switches wide enough to accommodate the transient pressure changes. This is undesirable because the pressure limits may need to be set wider than those required by the heating system for proper combustion.

Therefore, there is a need to accommodate the transient pressure changes resulting from abrupt fuel flow velocity changes that occur as a result of fuel valves being opened and closed. These transient pressure changes need to be accommodated without sacrificing proper combustion in the combustion chamber.

SUMMARY OF THE INVENTION

In the present invention, fuel pressure is monitored in a heating system where a controller controls actuation of fuel valves. A fuel threshold signal is provided to the controller for the purpose of determining if the fuel pressure crosses predetermined thresholds. After the controller has opened or closed a fuel valve, the fuel pressure threshold signal is ignored for a predetermined time interval.

DETAILED DESCRIPTION OF THE PREFERRED EMBODIMENTS

The present invention is suited for use where any fluid fuel is used in industrial burners or boilers. However, for simplicity's sake, this preferred embodiment of the present invention will be described only with respect to gas fuel.

Figure 1:
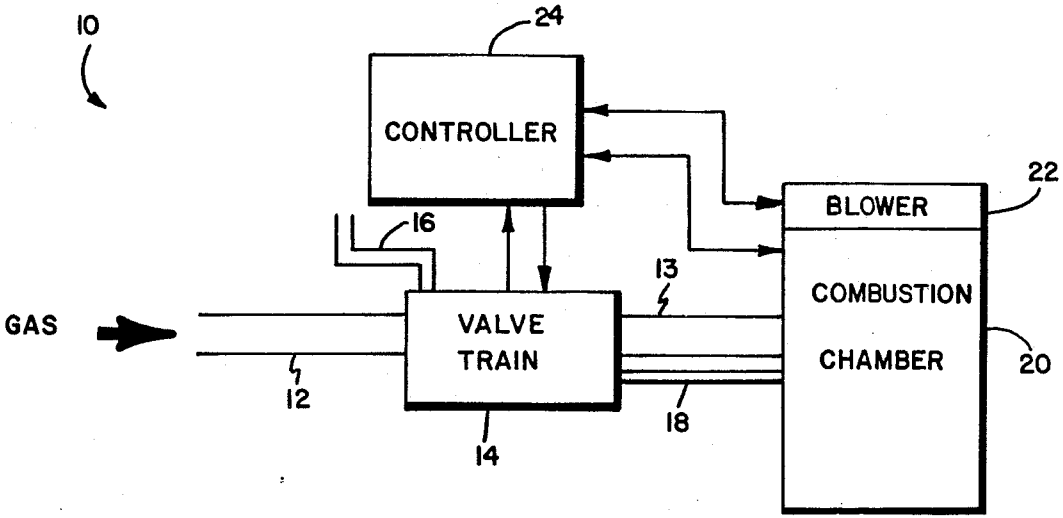
FIG. 1 is a block diagram of a heating system using the fuel pressure monitoring system of the present invention.

FIG. 1 shows a block diagram of heating system 10 which utilizes the monitoring system of the present invention. In one preferred embodiment, heating system 10 is a microprocessor based system and includes gas main 12, valve train 14, vent line 16, pilot line 18, main burner line 13, combustion chamber 20, blower 22 and controller 24. Gas is provided to heating system 10 through gas main 12. It enters valve train 14 where it encounters several components including valves, pressure regulators and pressure sensors. Gas exits valve train 14 through vent line 16, pilot line 18 and main burner line 13.

Fuel enters combustion chamber 20 through pilot line 18 and main burner line 13. Combustion air enters combustion chamber 20 through blower 22. Blower 22 also purges combustion chamber 20 prior to ignition and after a combustion cycle is complete.

Controller 24, which in this preferred embodiment is a microprocessor based controller, receives analog sensor inputs such as fuel temperature, fuel pressure, air pressure and a flame signal from valve train 14, combustion chamber 20 and blower 22. Based on those inputs and other inputs such as operator inputs, controller 24 controls heating system 10 by performing such tasks as actuating fuel valves and dampers and displaying operator messages.

Figure 2:
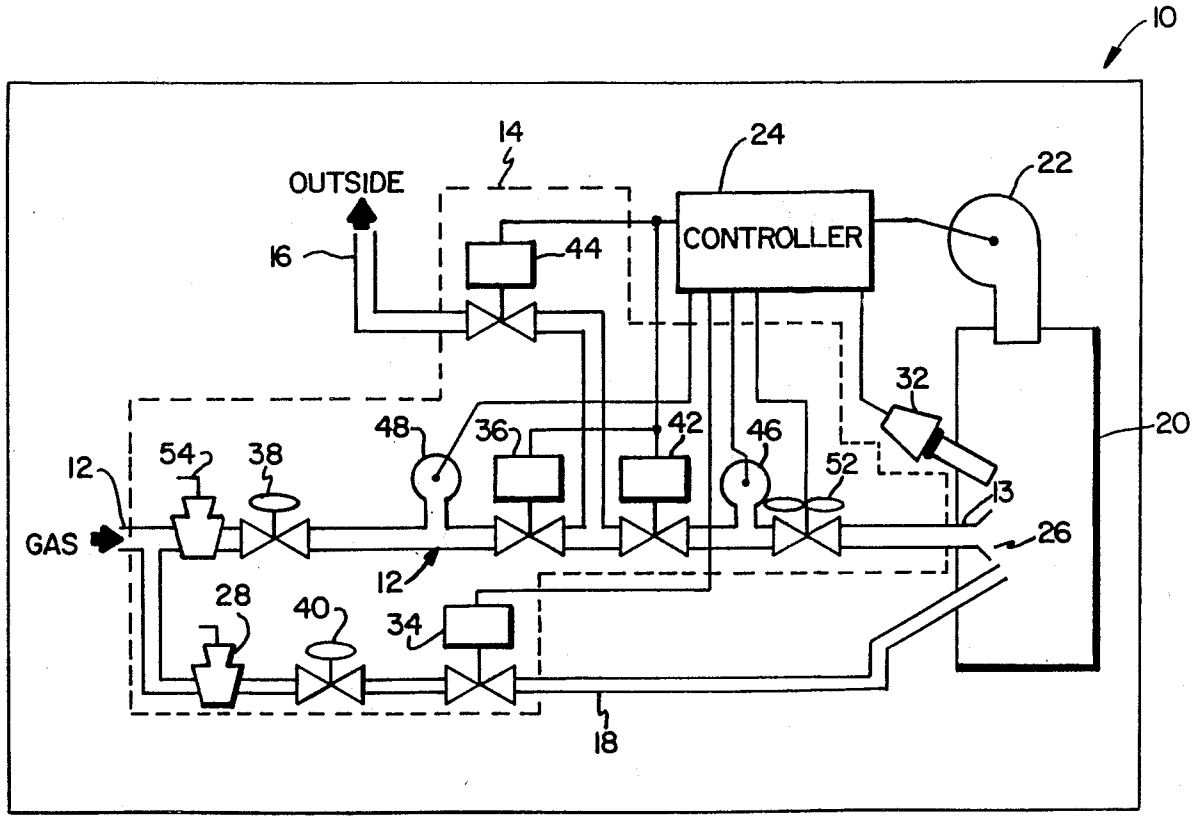
FIG. 2 is a detailed drawing of a heating system.

FIG. 2 is a diagram of heating system 10 showing valve train 14 in greater detail. Pilot line 18 is coupled to gas main 12 to provide pilot flame 26 in combustion chamber 20. This allows smooth ignition of the gas entering through gas line 13 into combustion chamber 20.

Since there are times when fuel will not be running through valve train 14, it is necessary to provide mechanisms to turn the gas off. Therefore, manual shut-off valves 28 and 54 are provided along with electrically actuated shut-off valves 36, 42, and 34.

If the flame goes out in combustion chamber 20, the gas must be immediately shut off so that a fuel-rich, explosive environment does not develop in combustion chamber 20. Therefore, flame detector 32 provides an input to controller 24 indicating the presence or absence of the flame. If flame detector 32 detects a flame-out condition in combustion chamber 20, controller 24 turns off all gas entering combustion chamber 20 by de-energizing safety shut-off valves 34, 36, and 42. It is desirable to deliver the fuel in gas main 12 to combustion chamber 20 at the proper pressure. Gas typically enters valve train 14 at high pressure. However, most gas burners are designed to operate with lower than gas-main pressures. Therefore, pressure regulators 38 and 40 are provided in valve train 14 to regulate fuel pressure in gas main 12 and pilot line 18, respectfully.

Safety shut-off valves can leak. Therefore, if heating system 10 is shut down for a substantial period of time (e.g. a weekend) and if safety shut-off valve 36 leaks, a fuel-rich environment could result in combustion chamber 20. For this reason, additional safety shut-off valve 42, vent line 16 and vent shut-off valve 44 are provided in many typical valve trains. When heating system 10 is shut down, both safety shut-off valves 36 and 42 are closed and vent shut-off valve 44 is open. If any fuel leaks through safety shut-off valve 36, it will be vented by vent line 16 to outside air. This is known as a "double-block-and-bleed" arrangement. Also, blower 22 is used to clear combustion chamber 20, before a flame is ignited, to remove any fuel which has accumulated there. Therefore, the hazard of leaking valves is substantially reduced.

During operation of heating system 10, more or less heat may be required in combustion chamber 20 (i.e, the load may vary). For that reason, it is desirable to have an adjustable firing rate which is responsive to the load required. This is provided by firing rate valve 52 which controls the fuel flow rate through gas main 12 in a load dependant manner during operation. Similarly, the air flow into combustion chamber 20 is controlled in a load dependent manner as well.

Periodic maintenance and valve replacement will also be required in valve train 14. Therefore, manual shut-off valve 54 is provided so that the fuel can be shut off upstream of the remaining components in valve train 14 for periodic maintenance.

If pressure regulator 38 in gas main 12 fails, there must be a warning mechanism to warn controller 24 to shut down heating system 10 in order to avoid a fuel-rich condition. Therefore, in prior systems high pressure switch 46, which was typically an electromechanical switch, was provided to warn controller 24 if the fuel pressure in gas main 12 exceeds a predetermined threshold. Additionally, to detect low pressure in gas main 12, low pressure switch 48, which was also typically an electromechanical switch, was provided. Low pressure switch 48 was located upstream of safety shut-off valves 36 and 42 so it did not issue a low pressure signal each time controller 24 closed safety shut-off valves 36 and 42.

Figure 3:
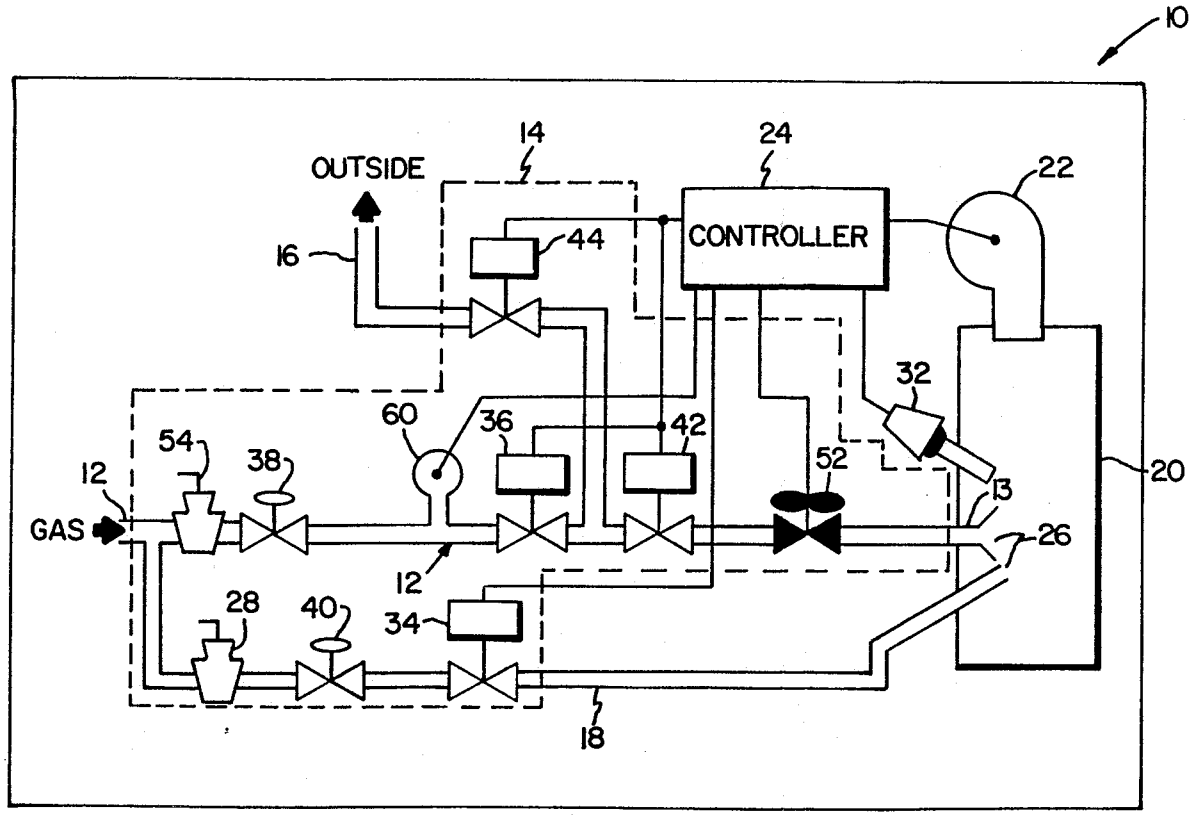
FIG. 3 is a detailed drawing of a heating system using the fuel pressure monitoring system of the present invention.

However, as discussed earlier, these electromechanical pressure switches caused nuisance shut-downs as a result of responding to pressure transients in the fuel main. Therefore, in the preferred embodiment, as shown in FIG. 3, electromechanical switches 46 and 48 are replaced with a single solid state pressure sensor 60 which provides controller 24 with a continuous, analog, pressure signal representing the fuel pressure in gas main 12. Controller 24 compares the pressure signal with threshold values (low and high) and shuts down heating system 10 if the pressure signal crosses either of the threshold values. This, by itself, does not solve the problems of responding to pressure transients.

Assuming manual shut-off valve 54 is open, the fuel velocity in gas main 12 will be abruptly affected by the opening and closing of safety shut-off valves 36 and 42 by controller 24. Because gas has mass, overcoming friction and inertia present problems. Since gas main 12 is resistive to the gas flowing through it, when safety shut-off valves 36 and 42 are opened by controller 24, there is friction to overcome by the gas. Overcoming the friction happens too quickly for pressure regulator 38 to immediately respond and pressure transient is created in gas main 12. The pressure transients can cause pressure sensor 60 to send controller 24 a pressure signal which is outside of the threshold values causing controller 24 to shut down heating system 10 unnecessarily.

Conversely, moving gas molecules have kinetic energy which can momentarily cause a compression when the shut-off valves 36 and 42 abruptly close. The resulting transient pressure increase in gas main 12 causes pressure sensor 60 to send controller 24 a pressure signal causing controller 24 to shut down heating system 18 unnecessarily.

In order to eliminate the problem of nuisance shut-downs occurring as a result of pressure transients generated by opening or closing safety shut-off valves 36 and 42, controller 24 is programmed to ignore any pressure signal generated by pressure sensor 60 for a predetermined time interval after controller 24 opens or closes safety shut-off valves 36 and 42. In this preferred embodiment, controller 24 is a microprocessor based controller and the predetermined time interval is set by either hardware or software timers. In this preferred embodiment, controller 24 ignores any pressure signal received by pressure sensor 60 for five seconds after it opens or closes safety shut-off valves 36 and 42. This momentary forgiveness of transient pressure changes in gas main 12 permits service persons to set fuel pressure limits closer to values required for proper combustion in combustion chamber 20.

Although the present invention has been described with reference to preferred embodiments, workers skilled in the art will recognize that changes may be made in form and detail without departing from the spirit and scope of the invention.

What is claimed is:

1. A method for monitoring fuel pressure in a heating system where a controller controls actuation of fuel valves, the method comprising the steps of:

providing a fuel pressure threshold signal to the controller for determining whether the fuel pressure reaches predetermined thresholds; and ignoring the fuel pressure threshold signal for a predetermined time interval after the controller has actuated a fuel valve, to compensate for momentary, transient pressure changes caused by actuation of the fuel valve.

2. The method of claim 1 and further comprising the step of:

responding to the fuel pressure threshold signal after the predetermined time interval.

3. The method of claim 2 wherein the step of responding to the fuel pressure limit signal further comprises the step of:

causing a safety shut-down state to be entered when the fuel pressure reaches the predetermined thresholds.

4. An apparatus for monitoring fuel pressure in a heating system where a controller controls actuation of fuel valves, the apparatus comprising:

sensing means for sensing the fuel pressure and for providing a fuel pressure threshold signal to the controller when the fuel pressure reaches a predetermined threshold; and masking means for masking the fuel pressure threshold signal for a predetermined time interval after the controller has actuated a fuel valve, to compensate for momentary, transient pressure changes caused by actuation of the fuel valve.

5. The apparatus of claim 4 and further comprising:

responding means for responding to the fuel pressure threshold signal after the predetermined time interval.

6. The apparatus of claim 5 wherein the responding means further comprises:

safety shut-down means for causing a safety shut-down state to be entered when the fuel pressure reaches a predetermined threshold.

* * * * *